US006076610A

United States Patent [19]

Zwergel

[11] Patent Number: 6,076,610

[45] Date of Patent: Jun. 20, 2000

[54] VEHICULAR FIRE EXTINGUISHING DEVICE

[76] Inventor: James C. Zwergel, 3896 Sardis Rd., Murrysville, Pa. 15568

[21] Appl. No.: 08/921,143

[22] Filed: Aug. 29, 1997

Related U.S. Application Data

[60] Provisional application No. 60/025,116, Aug. 30, 1996.

[51] Int. Cl.[7] ..... A62C 3/07

[52] U.S. Cl. ..... 169/62; 169/28; 169/73; 169/75

[58] Field of Search ..... 169/26, 28, 72, 169/73, 75, 59, 62

[56] References Cited

U.S. PATENT DOCUMENTS

| | | | |
|---|---|---|---|
| 3,139,143 | 6/1964 | Renda | 169/19 |
| 3,156,908 | 11/1964 | Kopan et al. | 340/228 |
| 3,889,752 | 6/1975 | Dunn | 169/59 |
| 3,993,138 | 11/1976 | Stevens et al. | 169/61 |
| 4,270,613 | 6/1981 | Spector et al. | 169/61 |
| 4,630,684 | 12/1986 | Cinzori et al. | 169/46 |
| 4,893,680 | 1/1990 | Wittbrodt et al. | 169/60 |

*Primary Examiner*—Andres Kashnikow
*Assistant Examiner*—Dihn Q. Nguyen

[57] ABSTRACT

A vehicular fire extinguishing or suppressing device that includes a pressurized vessel that houses a flexible bladder and contains a fire extinguishing composition. A disk assembly blocks an axial bore between the vessel and its exit in order to retain the fire extinguishing composition in the vessel. If a fire is detected in the vehicle, the disc assembly is perforated by the discharge of an explosive charge. The perforation of the disk assembly allows the escape of the fire extinguishing composition.

21 Claims, 2 Drawing Sheets

VEHICULAR FIRE EXTINGUISHING DEVICE

This Appln claims benefit of provisional Appln 60/025,116 Aug. 30, 1996.

BACKGROUND OF THE INVENTION (1) Field of the Invention

The present invention relates to fire extinguishing and suppressing devices and more particularly to fire extinguishing and suppressing devices for use in vehicles.

(2) Brief Description of Prior Art

In the prior art various types of fire extinguishing devices have been used in vehicles, particularly in industrial, military and racing vehicles. Because of increasing consumer demand for improved safety features, there has also recently been greater interest in using such fire extinguishing devices in passenger vehicles. An impediment, however, to the development of vehicular fire extinguishing systems has developed due to regulatory limits on the use of HALON and other similar fire extinguishing compositions. A need exists, therefore, for a fire-extinguishing device which may be effectively activated in response to a vehicular fire and which effectively extinguishes fires without the use of HALON or other similar compositions.

SUMMARY OF THE INVENTION

The vehicular fire extinguishing or suppressing device of this invention comprises a pressurized vessel which contains a fire extinguishing composition and which has a fire extinguishing exit means. The vessel includes a means for retaining the fire extinguishing composition in the vessel and a means for deactivating the means for retaining the fire extinguishing composition in the vessel in response to a sensing of a fire in the vehicle in which the device is used.

BRIEF DESCRIPTION OF THE DRAWINGS

Other objects, features and advantages of the present invention will become apparent upon reference to the following description of the preferred embodiments and to the drawings, wherein.

DETAILED DESCRIPTION OF THE DRAWINGS

Figure 1:
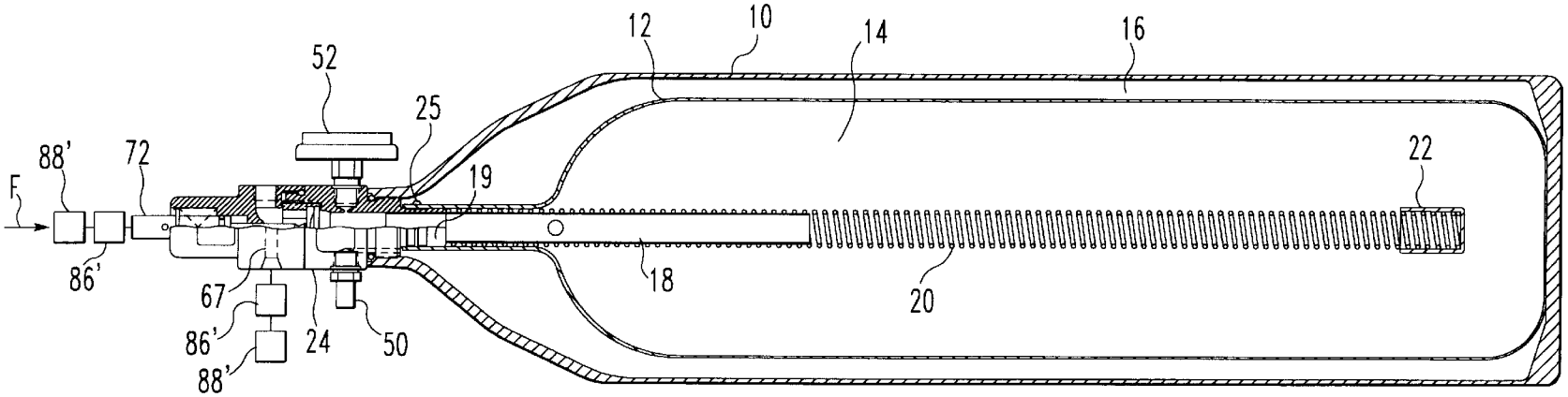
FIG. 1 is a front elevational view substantially in cross-section of a preferred embodiment of a fire extinguishing device of the present invention.
Figure 2:
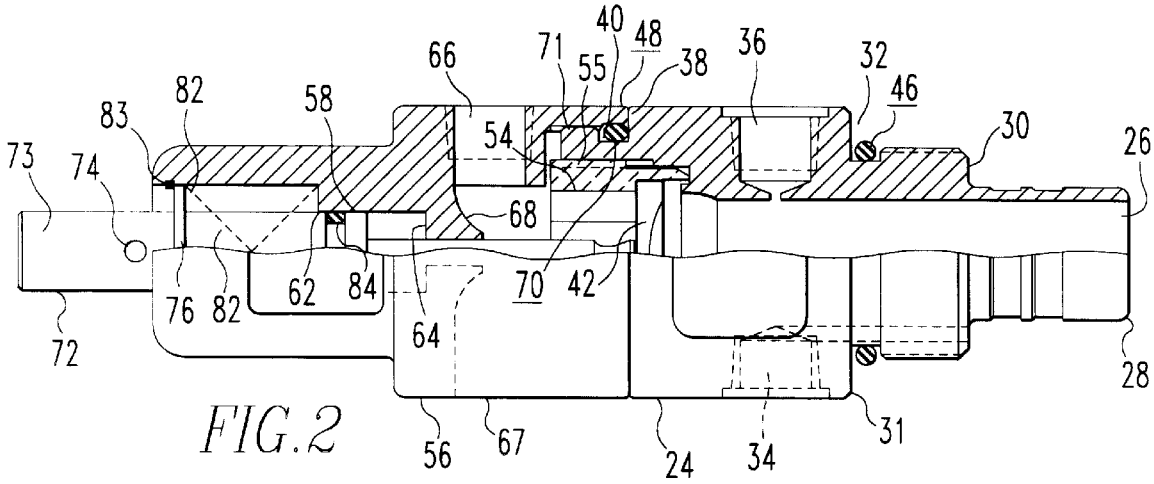
FIG. 2 is a detailed view of the pressure head and activator head elements within area II of FIG. 1.

Referring to the drawings, the fire extinguisher includes a rigid walled bottle 10. Inside this bottle there is a flexible bladder 12. Inside this bladder there is a fire extinguishing composition or fluid 14. Between the bottle wall and the flexible bladder there is a nitrogen gas charge 16. A drop tube 18 extends axially inside the flexible bladder from its center to its exit 19. A helical drop spring 20 extends from adjacent the exit of the flexible bladder concentrically outside the drop tube to the end of the drop tube and then further toward the opposed end of the flexible bladder. At its terminal end, the drop spring has a spring cap 22. In operation, the spring provides a flexible agent exit chamber during bladder compression and agent discharge. This flexible exit chamber prevents bladder pinching and puncture. Adjacent the exit of the flexible bladder the drop tube engages a pressure head shown generally at numeral 24 and is attached by clamp 25. This pressure head has an axial bore 26 which begins in an end engagement section 28 where the pressure head engages the drop tube and bladder. The pressure head also has shoulders 30 and 31, an O-ring groove 32, a charge valve receiving recess 34 and a gauge receiving recess 36. To its opposed end, the pressure head has another shoulder structure 38 and another O-ring groove 40. Inside the axial bore 26, there is positioned a bore closing disk assembly 42. In O-ring groove 32, O-ring 46 is positioned, and in O-ring groove 40, O-ring 48 is positioned. A charge valve 50 is positioned in charge valve receiving recess 34, and a charge pressure gauge 52 is mounted in gauge receiving recess 36. A nut 54 engaging screw threads 55 retains the bore closing disk assembly 42 in position relative to the pressure head. An activator head is shown generally at numeral 56. This activator head 56 includes an axial bore 58 that has axially spaced inner shoulders 62 and 64. Adjacent the in shoulder 64, there are discharge orifices 66 and 67 which have curved discharge surfaces as at surface 68. The activator head also has a peripheral longitudinal flange 70 which overlaps O-ring 48 and which is engaged to the pressure head by means of screw threads 71. Inserted in the axial bore 58 of the activator head 56 there is a plunger shown generally at numeral 72. This plunger is comprised of a main body section 73 that has a transverse aperture 74. The body section of the plunger also includes a radial flange 76 and an O-ring groove 78. At the inner end of the plunger there is a firing pin 80. Between the radial flange 76 and the inner shoulder 62 of the activator head there is a spring 82 which presses flange 76 against snap ring 83. O-ring 84 is positioned in O-ring groove 78. At the outer diameter of actuator head 56 there is an explosive charge shown schematically at numeral 86 which is attached via discharge orifice 67 and which may be any suitable commercially available explosive charge product. The explosive charge would be activated in the case of fire by means of a sensor that is shown schematically at 88 that may be any suitable commercially available fire detector. In operation, a fire inside the vehicle in which the above described device is mounted would be detected by heat sensor 88 which would activate explosive charge 86 which would apply inward burst pressure on disc assembly 42. As a result of such perforation, the fire extinguishing agent would exit the bladder through the drop tube and the axial bores in the pressure head and the axial head and would be released from the device through discharge orifice 66. It would also be possible to manually activate this system by applying an inward axial force F on plunger 72. The firing pin would then be moved axially and inwardly against disk assembly 42 so as to perforate that disk assembly and release the fire extinguishing agent from the bladder.

In an alternative embodiment, the explosive charge and heat sensor could be positioned in axial relation to the plunger 72 as is shown at numerals 86' and 88' respectively. In this alternate embodiment, a fire inside the vehicle in which the device is mounted would be detected by the heat sensor 88', which would activate explosive charge 86' which would apply inward axial pressure on plunger 72. The firing pin would then be moved axially and inwardly against disk assembly 42 so as to perforate that disk assembly. As in the first embodiment, such a perforation would cause the fire extinguishing agent to exit the bladder through the drop tube and the axial bores in the pressure head and the axial head and would be released from the device through discharge orifice 66.

Figure 3:
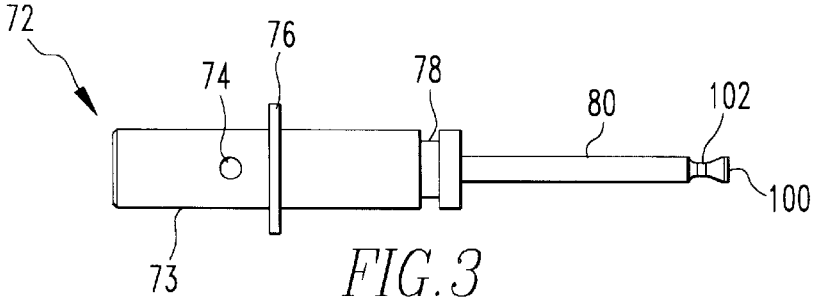
FIG. 3 is a detailed side elevational view of the plunger element used in the fire extinguishing device shown in FIG. 1.
Figure 4:
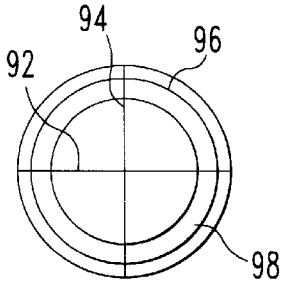
FIG. 4 is a top plan view of a disc assembly used in the fire extinguishing device of the present invention.
Figure 5:
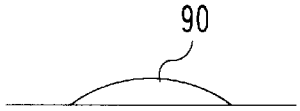
FIG. 5 is a side elevational view of the disc assembly shown in FIG. 4.

Referring to FIGS. 4 and 5, the disc assembly has a domed shaped profile 90. It has dome scores 92 and 94, a pedal score 96 and a hinge area 98. The disc can be ruptured or perforated by means of an explosive burst or by means of axial plunger motion. The disc is constructed of heat treated nickel alloy with non-intersecting exterior dome surface scores which are perpendicular in location to multiple non-continuous circular pedal scores. In operation, burst or plunger pressure causes dome scores to fracture and resultant agent flow opens disc segments outwardly hinging them at the un-scored area of the pedal line. Referring to FIG. 3, the plunger has a flat tip 100 firing pin preceded by an angularly adjacent under cut diameter 102. In operation, movement of the plunger assembly causes contact with the dome of the disc. The flat tip of the firing pin fractures the dome scores and penetrates the disc to a point of minimum undercut diameter. The resultant agent flow through this undercut area causes disc segment fracture.

It will be appreciated that a fire extinguishing device has been provided which allows for relatively simple and inexpensive construction and which may be efficiently activated to effectively suppress or extinguish vehicular fires.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A vehicular fire extinguishing or suppressing device comprising:

(a) a pressurized vessel comprising an outer rigid walled bottle and an inner flexible bladder with a pressurized gas interposed between said rigid wall and pressurized bladder, and said vessel having an exit means and an internal bladder containing a fire extinguishing composition in said flexible bladder;

(b) an axial bore connecting the fire extinguishing composition containing bladder and the exit means and a disc having a scored dome shaped section, wherein said disc is transversely positioned across the axial bore to close said axial bore to restrain release of the fire extinguisher composition; and (c) a disc penetrating means comprising an explosive charge and a pin mounted on a plunger and said pin has a flattened tip and is positioned in the axial bore and is aligned with the scored dome section of the disc, whereby activation of the explosive charge causes the plunger and the pin to move in the axial bore so that the flattened tip of the pin first fractures the scored dome shape section of the disc and then penetrates the disc to allow release of the fire extinguisher composition from the bladder first through the axial bore and then through the exit means.

2. The device of claim 1 wherein the fire extinguishing composition is a fluid.

3. The device of claim 2 wherein the pressurized vessel has a fire extinguishing fluid exit means and between said exit means and the fire composition containment means there is a fluid conveying means.

4. The device of claim 3 wherein the means for retaining the fire extinguishing composition in the vessel is a means for closing the pressurized fluid conveying means.

5. The device of claim 4 wherein the pressurized fluid conveying means is an axial bore and the means for closing the pressurized fluid conveying means is a disk transversely positioned across said axial bore.

6. The device of claim 5 wherein the disc is scored and dome shaped.

7. The device of claim 5 wherein the means for deactivating the means for retaining the fire extinguishing composition in the vessel is a means for perforating the disk transversely positioned across the axial bore.

8. The device of claim 7 wherein the means for perforating the disc transversely positioned across the axial bore is an explosive means.

9. The device of claim 8 wherein the explosive means is activated in response to the detection of a fire.

10. The device of claim 7 wherein the means for perforating the disk is a pin aligned with the axial bore.

11. The device of claim 9 wherein means are provided to move the pin axially to perforate the disk.

12. The device of claim 1 wherein the fire extinguishing composition is contained in a flexible bladder.

13. The device of claim 12 wherein the vessel has a rigid wall and a pressurized gas is interposed between the rigid wall of the vessel and the flexible bladder.

14. The device of claim 13 wherein the bladder is comprised of a noncorrosive material.

15. The device of claim 14 wherein the bladder is comprised of a resilient material.

16. The device of claim 15 wherein the pressurized gas is nonreactive.

17. The device of claim 16 wherein the pressurized gas is nitrogen.

18. A vehicular fire extinguishing or suppressing device comprising:

(a) a pressurized vessel having an exit means and an internal bladder containing a fire extinguishing composition, wherein said bladder is comprised of a flexible noncorrosive material and said pressurized vessel has a rigid wall and a pressurized non-reactive gas is interposed between the rigid wall of the vessel and the flexible bladder;

(b) an axial bore connecting the fire extinguishing composition containing bladder and the exit means and a disc having a scored dome shaped section, wherein said disc is transversely positioned across the axial bore to close said axial bore to restrain release of the fire extinguishing composition; and (c) a disc penetrating means comprising an explosive charge and a pin mounted on a plunger and said pin has a flattened tip and is positioned in the axial bore and is aligned with the scored dome section of the disc, whereby activation of the explosive charge causes the plunger and the pin to move in the axial bore so that the flattened tip of the pin first fractures the scored dome shaped section of the disc and then penetrates the disk to allow release of the fire extinguishing composition from the bladder first through the axial bore and then through the exit means.

19. A vehicular fire extinguishing or suppressing device comprising:

(a) a pressurized vessel having an exit means and an internal bladder containing a fire extinguishing composition;

(b) an axial bore connecting the fire extinguishing composition containing bladder and the exit means and a transversely positioned across the axial bore to close said axial bore to restrain release of the fire extinguishing composition; and (c) a disc penetrating means comprising an explosive charge and a flattened tip pin mounted on a plunger positioned in the axial bore and is aligned with the disc, whereby activation of the explosive charge causes the plunger and the pin to move in the axial bore to penetrate the disk to allow release of the fire extinguishing composition from the bladder first through the axial bore and then through the exit means.

20. The device of claim 19 wherein the pressurized vessel is comprised of an outer rigid walled bottle and an inner flexible bladder with a pressurized gas interposed between said rigid walled bottle and inner flexible bladder.

21. The device of claim 19 wherein the disc is scored and dome shaped and the pin has a flattened top.

* * * * *